United States Patent [19]

Spaulding

[11] Patent Number: 4,610,187

[45] Date of Patent: Sep. 9, 1986

[54] TOOL FOR APPLYING AND REMOVING A SPRING CLAMP

[75] Inventor: George E. Spaulding, Woodridge, Ill.

[73] Assignee: Wittek Industries, Inc., Broadview, Ill.

[21] Appl. No.: 800,678

[22] Filed: Nov. 22, 1985

[51] Int. Cl.[4] ..... B25B 27/00

[52] U.S. Cl. ..... 81/9.3; 72/410; 29/243.56; 140/93.4

[58] Field of Search ..... 81/9.3, 418, 424.5, 81/426; 72/409, 410; 29/243.5, 243.51, 243.56, 268; 140/93.4, 106

[56] References Cited

U.S. PATENT DOCUMENTS 2,508,555 5/1950 Whitney ..... 81/415

4,492,004 1/1985 Oetiker ..... 24/20 R

*Primary Examiner*—Roscoe V. Parker

*Attorney, Agent, or Firm*—Lyman R. Lyon

[57] ABSTRACT

A tool for applying and removing a spring clamp comprising a pair of handles, a pin joining the handles for relative rotation and a pair of jaws on the handles. One of the jaws is relatively thin in radial dimension relative to the axis of rotation thereof and the other of the jaws is relatively thick in radial dimension relative to the axis of rotation thereof whereby said tool is reversible to effect closure and opening of the spring clamp.

1 Claim, 4 Drawing Figures

TOOL FOR APPLYING AND REMOVING A SPRING CLAMP

BACKGROUND OF THE INVENTION

Spring clamps that are openable to effect assembly about a hose are well taught in the prior art. Often such clamps utilize a mechanical interlock in one form or another that requires a tool to effect closure of the clamp. While tools are known for closing such clamps, the problem of clamp opening has not heretofore been addressed much less solved by a tool that is usable to both close and open the clamp.

SUMMARY OF THE INVENTION

A tool for applying and removing a spring clamp is of pliers configuration having opposed jaws of unique configuration that effect closure of the clamp in one orientation relative to the clamp and opening of the clamp in a reverse orientation.

DETAILED DESCRIPTION OF THE PREFERRED EMBODIMENT OF THE INVENTION

Figure 1:
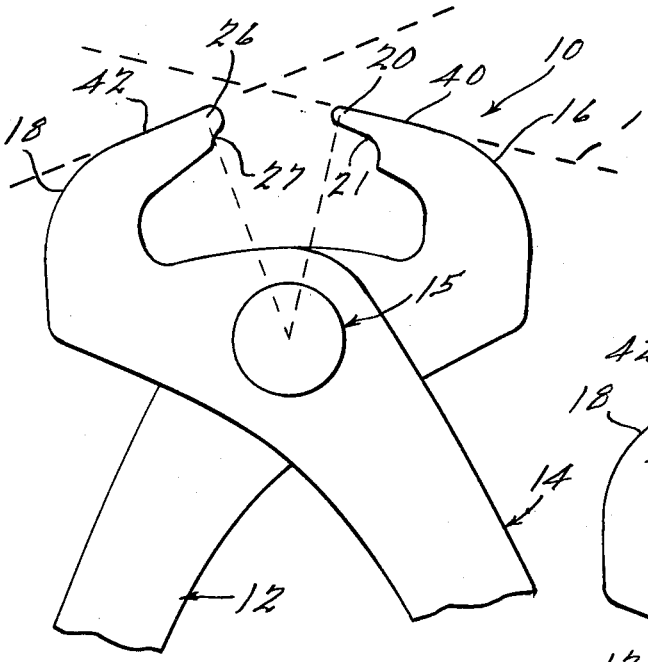
FIG. 1 is an elevational view of a tool in accordance with a constructed embodiment of the instant invention, in the open condition.
Figure 2:
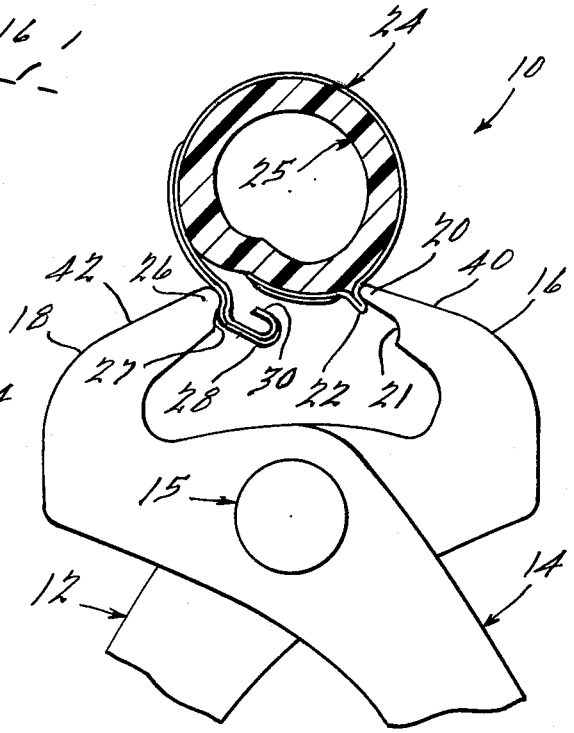
FIG. 2 is a fragmentary view showing the jaws of the tool in engagement with a clamp and rotated to the partially closed condition.

As seen in FIG. 1, a preferred constructed embodiment of the instant invention comprises a tool 10 having handles 12 and 14 that are pivoted for relative rotation on a pin 15. The handles 12 and 14 have jaws 16 and 18 thereon, respectively.

In accordance with the instant invention, the jaw 16 of the tool 10 has a relatively pointed end portion 20 with an underlying concave section 21 for engagement behind a latch 22 of a spring clamp 24. The clamp 24 is disposed about a hose 25. The opposite jaw 18 of the tool 10 has a relatively larger end portion 26 with a concave section 27 thereunder for engagement behind a latch hook 28 of the clamp 24.

Figure 3:
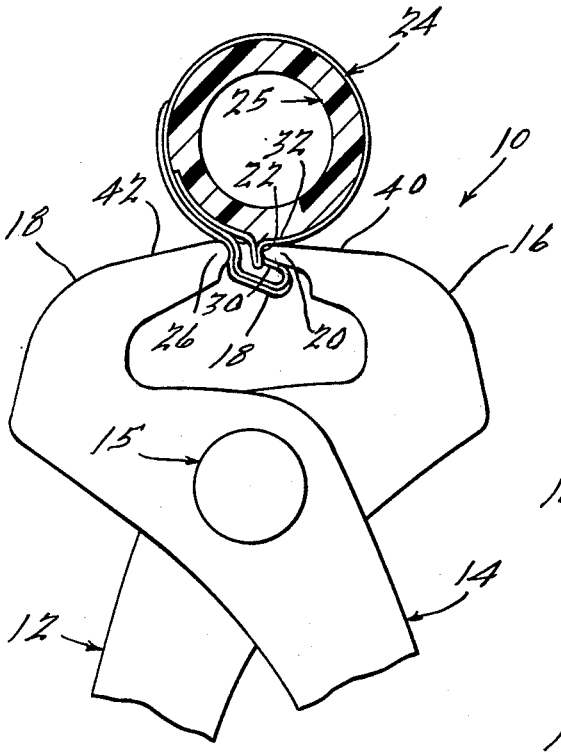
FIG. 3 is a view showing the clamp in the fully closed condition.

As seen in FIG. 3 of the drawings, movement of the handles 12 and 14 toward one another effects movement of the jaw end portions 20 and 26 toward one another and biasing of the latch hook 28 over the latch 22. It is to be noted that the end portion 20 on the jaw 16 of the tool 10 is sufficiently narrow to be interposed between a reentrantly folded end portion 30 of the latch hook 28 and a portion 32 of the clamp 24 adjacent the latch 22 thereon. It is to be noted that a pair of radially outer surfaces 40 and 42 on the jaws 12 and 14, respectively, are generally concentric with the axis of rotation thereof about the pin 15 so as to minimize clearance problems incident to closure of the clamp 10.

Figure 4:
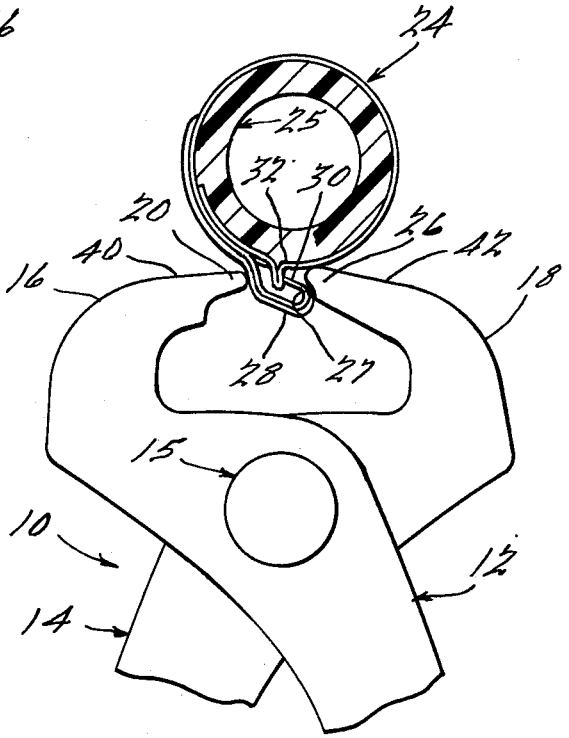
FIG. 4 is a view of the tool in the reversed condition relative to the clamp to effect opening thereof.

As seen in FIG. 4 of the drawings, yet another feature of the tool 10 is that it can be reversed relative to the clamp 24 to effect removal thereof from the hose 25 being clamped. In the condition illustrated in FIG. 4, the concave section 27 on the relatively large end portion 26 on the jaw 18 cams the end portion 30 of the latch hook 28 radially outwardly relative to the end portion 32 of the clamp 24 and latch 22 thereby to disengage the latch hook 28 from the latch 22.

From the foregoing description it should be apparent that the tool of the instant invention is relatively simple in construction yet accomplishes both assembly and dissambly of a clamp with a minimum of effort.

While the preferred embodiment of the invention has been disclosed, it should be appreciated that the invention is susceptible of modification without departing from the scope of the following claims.

I claim:

1. In combination with an openable spring clamp of circular configuration and having a radially outwardly extending latch at one end and a latch hook at the other end, said latch hook having a radially outwardly extending portion, a circumferentially extending portion and a radially inwardly and reentrantly folded portion, a tool for closing and opening said spring clamp comprising:

a pair of handles, a pin joining said handles for relative rotation, a pair of jaws on said handles, respectively, each of said jaws having a radially outer surface extending generally concentrically with the axis of rotation thereof about said pin, one of said jaws having an end portion that is relatively thin in radial dimension as related to the axis of rotation thereof and the other of said jaws having an end portion that is relatively thick in radial dimension as related, to the axis of rotation thereof, the thin end portion on said one jaw being engagable with the latch on said clamp and the thick end portion on said other jaw being engagable with the radially outwardly extending portion of the latch hook on said clamp whereby rotation of said jaws toward one another effects closure of said clamp, the thick end portion on the other of said jaws having a concave section on the radially inner face thereof engageable with the radially inwardly extending portion of the latch hook on said clamp upon reversal of said tool relative to said clamp thereby to cam said latch hook radially outwardly relative to said latch whereby said tool is reversible to effect both closure and opening of said spring clamp.

* * * * *